US005105965A

United States Patent [19]

Ullman

[11] Patent Number: 5,105,965

[45] Date of Patent: Apr. 21, 1992

[54] SINGLE FINGER-OPENING RESILIENT CAP

[75] Inventor: Myron E. Ullman, Canfield, Ohio

[73] Assignee: Boardman Molded Products, Inc., Youngstown, Ohio

[21] Appl. No.: 774,926

[22] Filed: Oct. 11, 1991

[51] Int. Cl.[5] ..... B65D 43/04

[52] U.S. Cl. ..... 220/281; 220/307; 220/DIG. 19; 215/211; 215/301

[58] Field of Search ..... 220/281, DIG. 19, 307; 215/211

[56] References Cited

U.S. PATENT DOCUMENTS

| | | | |
|---|---|---|---|
| 3,578,193 | 5/1971 | Steiner | 215/211 X |
| 3,934,745 | 1/1976 | Lovell | 220/281 X |
| 4,187,953 | 2/1980 | Turner | 220/281 X |
| 4,220,262 | 9/1980 | Uhlig et al. | 220/281 X |
| 4,413,748 | 11/1983 | Kessler et al. | 220/281 |
| 4,500,006 | 2/1985 | Lafortune et al. | 220/281 X |
| 4,691,839 | 9/1987 | Ullman | 220/281 |
| 4,809,871 | 3/1989 | Angelchik | 220/307 |

*Primary Examiner*—Stephen Marcus
*Assistant Examiner*—Paul A. Schwarz
*Attorney, Agent, or Firm*—Browdy and Neimark

[57] ABSTRACT

A single finger-opening resilient safety closure cap for use by arthritic sufferers needing quick and easy access into medication receptacles. The cap has a top wall and rim which fully covers and is pressure fitted in the opening of the receptacle. A finger-receiving well is formed into the top wall which when engaged and pushed permits enough deformation to release the rim of the cap from the opening.

17 Claims, 2 Drawing Sheets

SINGLE FINGER-OPENING RESILIENT CAP

FIELD OF THE INVENTION

The present invention relates to an improved container and more especially to a single finger-opening resilient cap for such a container, useful for holding medications or toxic components.

BACKGROUND OF THE INVENTION

Single finger-opening resilient safety closure caps are generally useful for arthritic sufferers needing quick and easy access into medication receptacles and the like. Most of these previously known closures include a finger depressible region for allowing a finger to press the closure, permitting the closure's removal from a container or receptacle. For example, U.S. Pat. Nos. 3,934,745 to Lovell; 4,187,953 to Turner; 4,220,262 to Uhlig et al; and 4,500,006 to Lafortune et al all disclose single finger opening collapsible closures for containers including finger depressible regions to convert the downward force executed by the finger into a disengagement force to remove the closure from the container. However, while these closures facilitate easy single finger removability, they are not "childproof", and therefore they allow children unauthorized access to a container's contents.

Rubber and other elastic bottle stoppers or plugs have been long known. The U.S. Pat. No. 3,578,193 to Steiner shows such an elastic stopper in the form of a single finger opening closure equipped with a finger receiving well, the closure being removed from a container when finger pressure is applied within the well. Also see Bramming, U.S. Pat. No. 2,746,632. Unfortunately, due to the closure's elasticity, changes in ambient temperatures may cause the premature opening of a container utilizing these types of closures. Additionally, elastic closures per se, typically used in conjunction with laboratory test tubes and the like, are relatively expensive to mass produce because of compounding requirements and the necessity of using relatively large quantities of material. Other disadvantages of elastic stoppers when employed in the pharmaceutical packaging industry include the fact that they are usually formed of compounded materials, components of which may cause contamination, or eventual degradation.

The U.S. Pat. No. 4,413,748 to Kessler et al discloses a double finger-collapsible closure equipped with a pair of spaced, D-shaped, finger receiving wells for permitting the removal thereof upon finger pinching motion as a one-piece molded structure, utilizing a resilient thermoplastic material, such as polyethylene or polypropylene, which does not readily deform or dis-shape when exposed to increased ambient temperatures. Furthermore, this cap is childproof as a child's attempt to deform or rotate a closure of this type would be very difficult, deterring further attempts of unauthorized access. However, this construction, because of having two finger wells, is often not suitable for smaller containers such as bottles. It is also sometimes difficult for arthritic sufferers to grasp and remove.

The U S. Pat. No. 4,691,839 to Ullman discloses a round two-well single finger-collapsible closure for permitting the removal thereof. The cap is removed by inserting a single finger within the finger receiving well, pressing the side wall thus contractably deforming a bar shaped portion and the sidewall of the second well, disengaging the cap and then lifting the cap upwardly.

While being a useful device, it is more difficult and expensive to manufacture than the present invention. Further, the rectangular or square configuration of the cap according to the present invention and the opening which it closes provides a greater pour area at the edge of a round can in comparison to a round cap and opening on a can holding equivalent material. This square or rectangular pour area clearly results in a faster pour for equivalently contained material.

Containers for keeping potentially dangerous materials, such as medicines or toxic materials such as lye, must be provided with closures which are easy to install and remove, and which securely retain the solid materials within their containers. Closures must be operable with sufficient ease to assure that container contents are not inadvertently spilled or otherwise discharged during closure installation or removal.

It is desirable that closures for dangerous material containers be "childproof" in the sense that at least two distinct types of movements must be performed in proper sequence to effect closure removal. Furthermore, it is desirable that such closures have relatively simple configurations which can be molded easily from relatively inexpensive plastic materials. Additionally, in some instances there is a need to provide closures which will prevent pressure buildups by venting gases from within a container.

Except for Kessler U.S. Pat. Nos. 4,413,748 and Ullman 4,691,839, previously proposed container closure caps have not adequately addressed the foregoing needs. Many are either undesirably difficult to operate, or they close insecurely. Many are of unduly complex configuration, have unattractive appearances, and/or are undesirably expensive to mold from plastic materials. Most fail to address the need for a gas venting capability.

In comparison to the present invention, no single finger opening resilient cap has previously been available which will very simply prevent an unauthorized child's access, provide an easy removable closure for adults, especially adults afflicted with arthritis and at the same time reduce manufacturing costs and increase the pour rate of an equivalent material.

SUMMARY OF THE INVENTION

Accordingly, it is an object of the present invention to overcome the deficiencies of the prior art, such as those indicated above.

It is a further object of the present invention to provide for improved closure of medicine bottles.

It is another object to provide an improved single finger-opening resilient cap made from resilient thermoplastic materials.

It is still another object of the present invention to provide a single-finger opening resilient cap which, when employed as a pharmaceutical container closure, will prevent unauthorized access by children to the container's contents.

It is another object of the present invention to provide a single-finger opening resilient cap which will not readily dis-form or dis-shape when exposed to elevated ambient temperatures.

It is another object of the present invention to provide a single-finger opening resilient cap which is simple and inexpensive to manufacture on a high volume basis.

It is still another object of the present invention to provide a single-finger opening resilient cap having simple and quick removability, particularly for adults afflicted with arthritis or the like.

It is yet another object of the present invention to provide a square or rectangular single-finger opening resilient cap for closing a corresponding opening, which permits a faster pour rate than prior art round closures when handling equivalent material.

Still other objects, features and attendant advantages of the present invention will become apparent to those skilled in the art from a reading of the following detailed description of embodiments of the invention accordance therewith, taken in conjunction with the accompanying drawings, wherein:

DESCRIPTION OF THE PREFERRED EMBODIMENT

Figure 1:
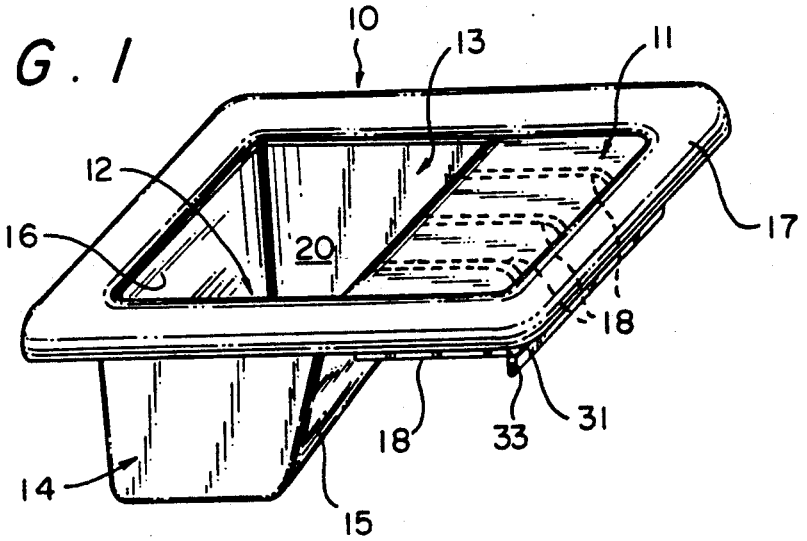
FIG. 1, is a perspective view of a single-finger square or rectangular opening resilient cap according to the present invention.
Figure 2:
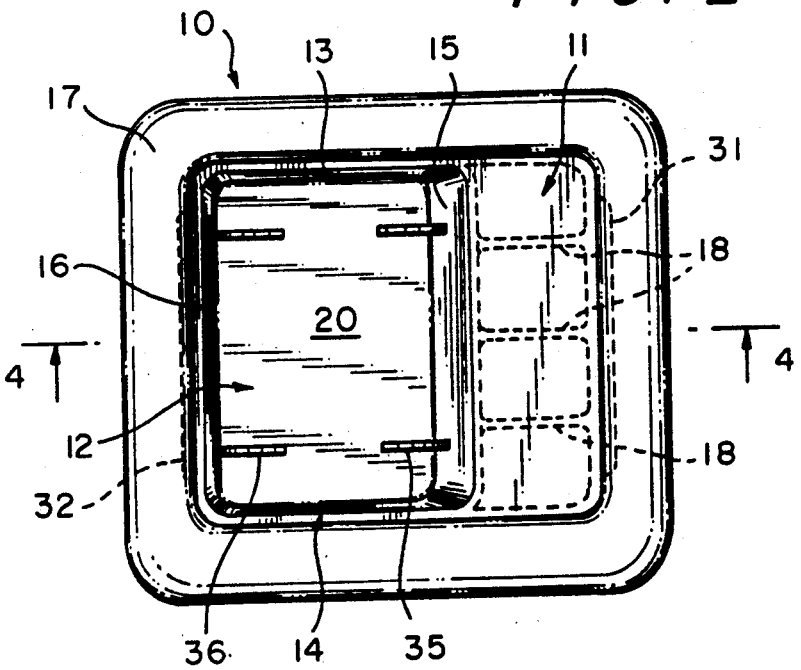
FIG. 2, is a plan view of the single-finger square or rectangular opening resilient cap of FIG. 1.

A presently preferred embodiment of a molded resilient cap 10 according to the present invention is illustrated in FIGS. 1 and 2 of the drawings. The resilient cap 10 has a sturdy thin-walled construction preferably formed from a resilient thermoplastic material, such as polyethylene or polypropylene or the like. The cap 10 includes a generally square or rectangular shaped finger-receiving well 20 extending from a top wall 11. The walls of the cap 10 comprising the finger-receiving well 20 and a bottom wall 12, two flat side walls 13, 14, a finger wall 15, and a bead wall 16. The cap 10 also has an arch shaped lip 17, stiffener ribs 18 and a second bead wall 19.

The arch shaped lip 17 or edge portion extends circumferentially around the top of the cap 10 forming a generally 10 square or rectangular rim and is connected to the top wall 11 and also the top edge of the finger-receiving well 20. The lip 17 has a size greater than that of the container opening that is to be closed by the cap 10 and is configured to overlay the container portions which surround the container opening. The bottom wall 12, flat side walls 13, 14, finger wall 15 and bead wall 16 form a generally square or rectangular shaped finger-receiving well 20 extending downwardly from the top wall 11 and from the arch-shaped lip 17. The finger-receiving well 20 receives therein a finger.

The finger wall 15 is connected to the top wall 11 in a slightly slanted but approaching perpendicular manner. The bead wall 16 is near parallel to the finger wall 15 and the flat side walls 13, 14 are connected to the finger wall 15 and bead wall 16. The bottom wall 12 which is approximately parallel with the top wall 11, is connected to the finger wall 15, the bead wall 16 and the flat side walls 13, 14. As best illustrated in FIG. 2, the opening width of finger receiving well is approximately two times the width of the top wall 11.

Figure 4:
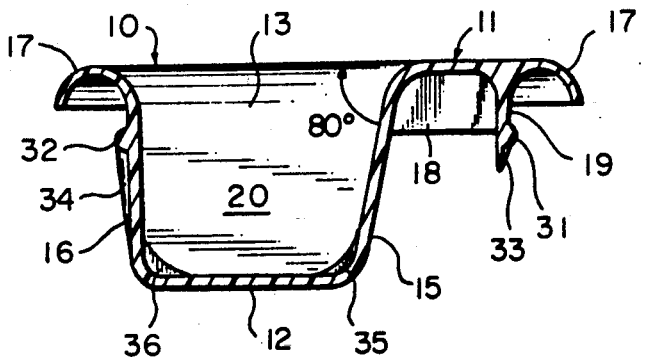
FIG. 4 is a cross-sectional view of the single-finger opening resilient cap taken along the line 4—4 in FIG. 2.
Figure 5:
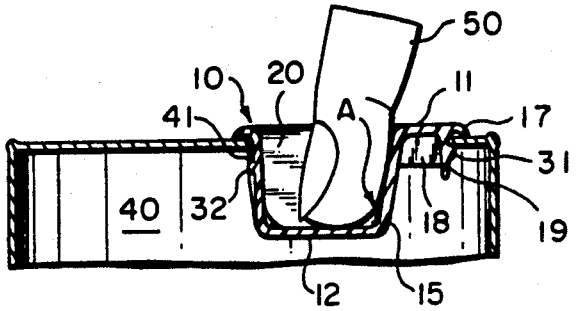
FIG. 5 is a cross-sectional view of the single-finger opening resilient cap in a container opening taken along the line 4—4 in FIG. 2, showing the use thereof in conjunction with a receptacle and simulating a method of single finger opening removal of the cap from the receptacle.
Figure 7:
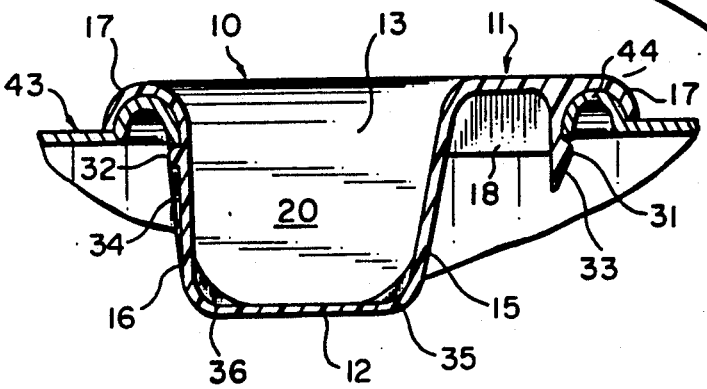
FIG. 7 is a cross-sectional view of the single-finger opening resilient cap taken along the line 4—4 in FIG. 2 showing the use thereof in connection with a receptacle with a raised rim.

The cap 10 includes a series of stiffener ribs 18 perpendicularly attached to the finger wall 15, the top wall 11 and the second bead wall 19. As best illustrated in FIGS. 4 and 7, the finger wall 15, the top wall 11 and the second bead wall 19 are connected in a generally inverted "U" shaped relationship. As further illustrated in FIG. 4, the stiffening walls 18 extend from the top wall 11 down approximately one third of the finger wall 15 and two thirds down the second bead wall 19 although other lengths of the stiffener wall 18 could also be employed as shown in FIG. 5 where the stiffening wall 18 extends down approximately one half of the finger wall 15 and fully down bead wall 19. The stiffener walls 18 serves to hold the cap 10 in a fully extended shape when inserted into a container. The stiffener walls 18 need to be pliable enough that they are contractably deformable when pressed with a finger. The stiffener walls 18 can also serve to transfer force to the second bead wall 19.

Figure 3:
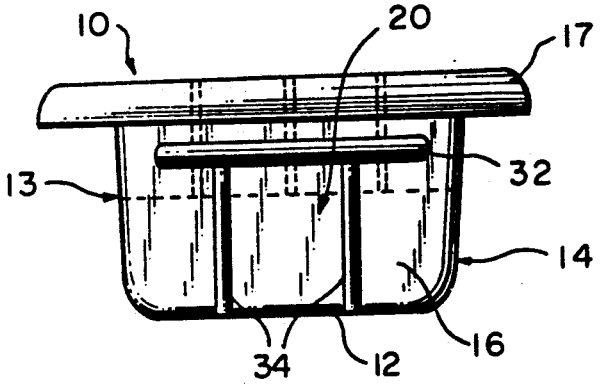
FIG. 3 is a side elevational view of the single-finger opening resilient cap of FIGS. 1 and 2.

As shown in FIG. 4, the second bead wall 19 extends perpendicularly from the top wall 11 and the stiffener walls 18 and is approximately parallel to the finger wall 15. The second bead wall 19 has a locking bead or projection 31 located parallel to the plane of the top wall 11. The bead wall 16 of the finger-receiving well 20 has a locking bead or projection 32 located in a plane which includes projection 31 and is parallel to the plane of the top wall 11. The locking beads 31, 32 are oppositely spaced semi-circular ridges extending outwardly from the walls. Both locking beads 31, 32 have a plurality of spaced, tapered guide projections 33 and 34, respectively, there beneath. The locking bead 31 is located on the second bead wall 19 in the illustrated embodiment as shown in FIGS. 3 and 4, approximately, two thirds the distance down on wall 19 from the top wall 11. The locking bead 32 is located on the first bead wall 16, approximately, one third the distance down wall 16 from the top of the arch shaped lip 17. It will be understood however, that these dimensions are selected bearing in mind the height of the lip of the bottle or can to be capped, so that the beads 31, 32 will fit under the bottle or can bead. The locking beads 31, 32 are desirably identical to one another in a generally rod shape, although the locking beads 31, 32 may be somewhat shorter or longer than the bead 31, 32 illustrated.

The locking beads 31, 32 and their respective tapered guide projections 33, 34 are utilized to maintain the cap 10 in a locking position when lodged in a closure opening, it being 15 understood that the guide projections 33, 34 serve as ramps to enable the cap 10 to flex as the internal closure lip of the bottle opening presses against the guide projections, causing inward compression of the cap during placement of the cap 10 on and in the neck of the bottle being sealed. It should also be noted that the spaced tapered guide projections 33, 34 are perpendicularly-aligned integrally with the locking beads 31, 32.

As can best be seen in FIGS. 2 and 4, the finger receiving well 20 includes the slanted, generally planar finger wall 15 which is positioned between the top wall 11 and the bottom wall 12 and in a plane at an angle of preferably at least 75° and at most 89° relative to the plane defined by the cap's top wall 11. As shown in FIG. 4, the finger wall 15 is in a plane at an angle of about 80° relative to the plane defined by the cap's top wall 11. When finger pressure is exerted against the finger wall 15, cap 10 is easily removed from a container's neck opening.

The cap further includes optional reinforcing ribs 35, 36 inside the finger-receiving well 20 extending from the bottom wall 12 up the finger wall 15 and the bead wall 16 providing additional support to the cap 10. The optional reinforcing ribs 35 and 36 extend upwardly on bead wall 15 and 16 approximately one-fourth of the height of the walls and transversely approximately one fourth of the width of bottom wall 12 thereby forming an arch from end to end of ribs 35 and 36. It will be understood that other lengths can be employed for the optional reinforcing ribs. The optional reinforcing ribs 35, 36 serve to assist in holding the cap 10 in a fully extended shape when inserted into a container.

Referring now to FIG. 5 of the drawings, cap 10 is shown as a closure for metal can 40 having a rectangular opening with a downturned rim 41 for receiving and mating with the locking beads 32, 33 of the cap 10. Cap 10's arched shaped lip 17 is configured to provide a rounded outer-surface that is not easily engaged by one's fingernail, whereby the likelihood of a person (such as a child) being able to grasp the lip 17 to remove the cap 10 from the container 40 is essentially eliminated.

As shown in FIG. 5, the cap 10 is readily removable from the container opening by inserting a single finger 50 within the finger receiving well 20. As illustrated by the direction of the arrow A, finger pressure is exerted against finger wall 15 causing at least the locking bead 32 on the bead wall 16 to move sufficiently inwardly with respect to the receptacle opening to thereby release from its engagement with the receptacle so that the cap 10 can be lifted out of the receptacle opening. The finger force as illustrated in FIG. 5 effectively causes the cap structure to pivot and allow the bead 32 to clear the metal can rim 41, thereby permitting disengagement of the cap 10 from the receptacle lip. It should be understood that as finger force is exerted on the finger wall 15 the stiffener ribs 18 contractably deform, yet return to their original or normal configuration once finger pressure against the finger wall 15 is released. To complete the removal of the cap 10, the cap 10 is pulled in an upward motion pivoting the cap 10 at the second bead wall 19 between the bead 31 and the arch shaped rim 17 around the downturned rim 41 of the metal can 40. The arch shaped rim 17 needs to be pliable enough that it can contractably deform when pressed during the removal of the cap 10.

The amount of removal force or the force exerted by the finger can be adjusted by varying the length, width and number of the stiffener ribs 18. The amount of force required is also a function of the depth and inclination of the finger wall 15, and the flexibility of the cap walls. If desired, the finger wall 15 may be roughened or provided with horizontal ridges to improve finger contact during the final upward finger thrust to remove the cap. The amount of removal force can also be adjusted by varying the length and thickness of the locking beads 31, 32 and the shape of the rim 17.

The finger force exerted against the finger wall 15 is different from the motion used in Ullman U.S. Pat. No. 4,691,839 which is a single continuous arc like motion for removing the cap, whereas the present invention uses a two directional movement The present invention is easy for adults to use which is especially beneficial for adults afflicted with arthritis but difficult for small children to remove the cap 10.

Figure 6:
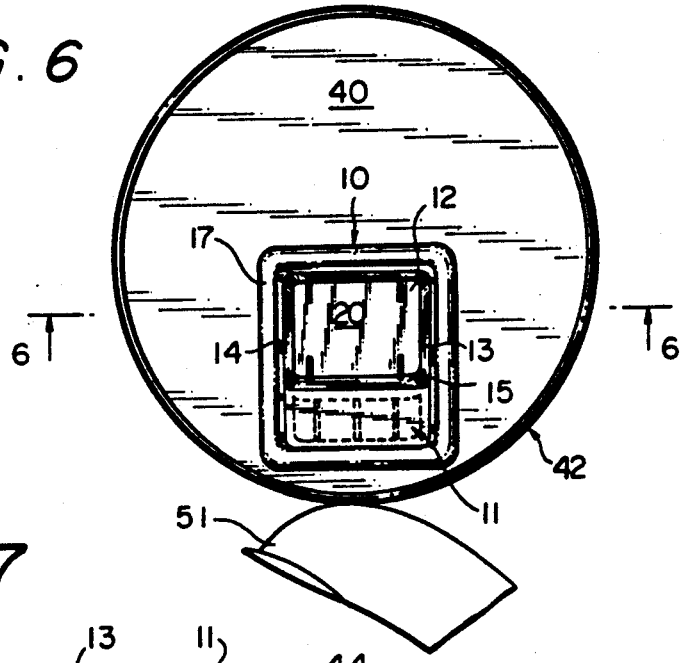
FIG. 6 is a plan view of the single-finger opening resilient cap of FIG. 5.

FIG. 6 shows a plan view of the single-finger opening resilient cap 10 of FIG. 5 positioned in a metal can 40. With this embodiment, by placing the cap 10 near the side of the metal can 42 one can achieve additional leverage using the thumb 5 to assist in the removal of the cap 10. This embodiment of the invention is especially beneficial for adults afflicted with arthritis.

FIG. 7 shows another embodiment of the single-finger opening resilient cap 10 in conjunction with a receptacle 43 with a raised rim 44. In this embodiment the seal between the cap 10 and the receptacle 43 is a tight fit. This embodiment is particularly useful for sealing metal receptacles with slick surfaces.

While such orientation words as "top", "bottom", "upward", "downward" and the like are utilized herein, it will be understood that the cap of the present invention may be positioned in attitudes different from those described and illustrated. Accordingly, it will be understood that such orientation words as are utilized therein are intended to facilitate an understanding of the relative orientation of various components corresponding to the figures of the drawings and are not to be construed as limiting.

It will be obvious to those skilled in the art that various other changes and modifications may be made without departing from the scope of the invention and therefore the invention is not to be considered limited to what is shown in the drawings and described in the specification.

The foregoing description of the specific embodiments will so fully reveal the general nature of the invention that others can, by applying current knowledge, readily modify and/or adapt for various applications such specific embodiments without departing from the generic concept, and therefore such adaptations and modifications are intended to be comprehended within the meaning and range of equivalents of the disclosed embodiments. It is to be understood that the phraseology or terminology herein is for the purpose of description and not of limitation.

What is claimed is:

1. A single finger opening resilient cap for insertion into a square or rectangular container opening to releasably close the opening, comprising:

a top wall with edge portions which form a rim having a size which is greater than that of the container opening that is to be closed by the cap, said rim being configured to overlay container portions which surround the container opening, said top wall defining a first plane;

a finger-receiving well formed in said top wall, including a bottom wall and a slanted finger wall extending between said top wall and said bottom wall, said finger wall defining a second plane disposed at an angle relative to said first plane, said well being of size sufficiently large to receive therewithin a finger;

a first flat wall portion depending from said top wall at a location inset from said rim forming a wall of said well;

a second flat wall portion depending from said top wall at a location inset from said rim and a distance from said well;

locking means carried on said first flat wall portion and on said second flat wall portion for engaging said closure opening;

a contractably-biasing means extending below said top wall, outside said finger-receiving well and approximately perpendicular to and connecting said slanted finger wall and said second flat wall portion for contracting when pressed and returning to a normal position when released; and whereby single finger force exerted on said slanted finger wall within said finger-receiving well will deform said cap thereby disengaging said locking means from said closure opening and release said cap from said closure opening.

2. A single finger opening resilient cap in accordance with claim 1, wherein said cap is formed from a one-piece, resiliently deformable structure molded from resilient plastic material and which has a memory that tends to return said cap to its normal configuration if said cap has been deformed.

3. A single finger opening resilient cap in accordance with claim 2, wherein said resilient plastic material comprises polyethylene or polypropylene.

4. A single-finger opening resilient cap in accordance with claim 1, wherein said contractably-biasing means comprises a plurality of flat ribs, parallel to one and other and perpendicular to said finger wall, said top wall and said second flat wall portion.

5. A single-finger resilient cap in accordance with claim 4, wherein said plurality of flat ribs is comprised of at least three ribs.

6. A single-finger opening resilient cap in accordance with claim 1, wherein said finger-receiving well extends at least twice as far from said top wall as said contractably-biasing means.

7. A single finger opening resilient cap in accordance with claim 1, wherein said edge portions are generally configured in an arch shape.

8. A single-finger opening resilient cap in accordance with claim 1, wherein said angle of said slanted finger wall defining a second plane relative to said first plane, in said finger-receiving well, is at least 75° and at most 89°.

9. A single-finger resilient cap in accordance with claim 1, wherein the opening width of said finger-receiving well is approximately two times the width of the top wall 11.

10. A single-finger opening resilient cap in accordance with claim 1, wherein said locking means comprises a pair of oppositely spaced semi-circular ridges extending outwardly from said first flat wall portion and said second flat wall portion.

11. A single-finger opening resilient cap in accordance with claim 10, wherein said locking means further includes a plurality of spaced perpendicularly aligned tapered guide projections extending downwardly from said ridges.

12. A single-finger opening resilient cap in accordance with claim 8, wherein said angle of said slanted finger wall is approximately 80°.

13. A single-finger opening resilient cap in accordance with claim 8, wherein said angle of said slanted finger wall is approximately 89°.

14. A single-finger opening resilient cap in accordance with claim 1, wherein said contractably-biasing means extends down approximately one third of said finger wall and approximately two thirds down said second flat wall portion.

15. A single-finger opening resilient cap in accordance with claim 1, wherein said contractably-biasing means extends down approximately one half of said finger wall and approximately fully down said second flat wall portion.

16. A single-finger opening resilient cap in accordance with claim 1, wherein said contractably-biasing means extends down approximately half of said finger wall and approximately two thirds down said second flat wall portion.

17. A single-finger opening resilient cap in accordance with claim 1, wherein said finger wall is approximately twice as long as said second flat wall portion which depends from said top.

* * * * *